United States Patent [19]

McCoy

[11] Patent Number: 5,058,366

[45] Date of Patent: Oct. 22, 1991

[54] SAFETY RELEASE ATTACHMENT FOR STIRRUP

[76] Inventor: Michael J. McCoy, 2629 Red Bridge Rd., Laurel, Mont. 59044

[21] Appl. No.: 594,636

[22] Filed: Oct. 5, 1990

[51] Int. Cl.[5] ..... B68C 3/00

[52] U.S. Cl. ..... 54/49

[58] Field of Search ..... 54/47, 49, 48

[56] References Cited

U.S. PATENT DOCUMENTS

| | | | |
|---|---|---|---|
| 445,411 | 1/1891 | Pearson et al. | 54/49 |
| 4,869,053 | 9/1989 | Bradford et al. | 54/49 |

FOREIGN PATENT DOCUMENTS

| | | | |
|---|---|---|---|
| 85469 | 2/1896 | Fed. Rep. of Germany | 54/49 |
| 25860 | of 1905 | United Kingdom | 54/49 |

*Primary Examiner*—Robert P. Swiatek

*Attorney, Agent, or Firm*—Jacobson and Johnson

[57] ABSTRACT

A stirrup for a horse saddle has a cylindrical stirrup bolt assembly attached across an open end of the stirrup and, in a conventional fashion, the bolt assembly rests in the bottom loop of a stirrup strap which is attached to the saddle fender to hold the stirrup in place during normal use. The stirrup bolt assembly comprises an outer housing with rotatable and axially movable pins or rods which have keyed outer ends extending out the end of the housing for engaging keyed openings at the open end of the stirrup with a spring within the cylindrical housing applying a force to the pins to hold them in engagement with the stirrup keyed openings. A helically shaped slot or groove on the outer surface of the pins is engaged by fingers attached to the cylindrical housing so as the stirrup swings in an arc with respect to the stirrup strap the fingers act in the slot to apply a force in opposition to the spring force to pull the pins axially inward. If the angle of the arc of the stirrup exceeds a predetermined angle, the rods or pins are moved inward far enough so that they disengage from the openings in the stirrup so that the stirrup will fall free and thereby disengage the stirrup and the rider's foot from attachment to the saddle.

3 Claims, 2 Drawing Sheets

31
18
30
17
16
21
15
24
25
10
19
14
13
12
11

SAFETY RELEASE ATTACHMENT FOR STIRRUP

FIELD OF THE INVENTION

This invention is for use with a stirrup of a horse-riding saddle to provide a somewhat automatic mechanism for releasing the stirrup from its attachment to the saddle in the event the rider's foot is caught in the stirrup while dismounted to prevent the rider from being dragged along the ground if the horse bolts.

DESCRIPTION OF THE PRIOR ART

The closest and most pertinent prior art is shown and described in U.S. Pat. No. 4,869,053 dated Sept. 26, 1989, titled "QUICK RELEASE SAFETY ATTACHMENT FOR A STIRRUP" by Bradford and McCoy.

As described in the '053 patent, the conventional manner of attaching a stirrup to a riding saddle, prior to the '053 patent, was by a stirrup bolt or a bar extending across the open end of the stirrup and resting in the bottom loop of a stirrup strap which is attached to and extends downward from a saddle fender. The rider usually uses the stirrup for mounting and while riding resting his or her feet in the stirrup. If the rider is not mounted in the saddle and his or her foot is caught or entangled in the stirrup and the horse should bolt, the rider would be dragged along the ground and be subject to serious injury. The '053 patent provides a means for releasing the stirrup from its attachment to the saddle in an emergency of this nature by using a stirrup bolt assembly resting in the bottom loop of the stirrup strap with spring-loaded axially movable rotatable pins extending out the ends of the assembly for engaging slotted or keyed openings in the ends of the stirrup. The spring acts on the pins urging them axially inward; that is, out of engagement with the stirrup but an arm having fingers extending into the bolt assembly hold the rods or pins axially outward in engagement with the stirrup openings. If the stirrup should swing in an arc greater than a predetermined angle, which ordinarily is the case when an emergency of the nature described occurs, the fingers are released from their engagement with the pin so that the spring takes over and pulls the pins inward to disengage them from the stirrup openings and thereby release the stirrup from its attachment to the saddle so that the rider will not be pulled along the ground.

SUMMARY OF THE INVENTION

The instant invention is similar in a number of respects to the device described in the aforementioned '053 patent. It utilizes a cylindrical assembly as the stirrup bolt assembly which rests in the bottom loop of the stirrup strap and has movable pins or rods within a cylindrical housing with the keyed or notched ends of the rods extending axially out of the housing to normally engage similarly keyed openings in the stirrup for holding the stirrup attached to the saddle. A spring is located in the cylindrical housing between the inner ends of the rods and is under compression thereby urging the rods axially outward into engagement with the stirrup openings. The outer cylindrical surfaces of the rods have a somewhat helical shaped slot or groove and the cylindrical housing has fingers engaged in the slots and the outer cylindrical housing is mounted so that it does not rotate about its long axis. When the stirrup swings in an arc it correspondingly causes the pins or rods to rotate within the housing. As the pins rotate the fingers engaged in the helical slots or grooves force the pins to move axially inward in opposition to the spring force. At a predetermined angle of arc of the stirrup the pins will be drawn far enough inward so that they will disengage from the stirrup thereby releasing the stirrup from its attachment to the saddle.

DESCRIPTION OF THE PREFERRED EMBODIMENT

Figure 1:
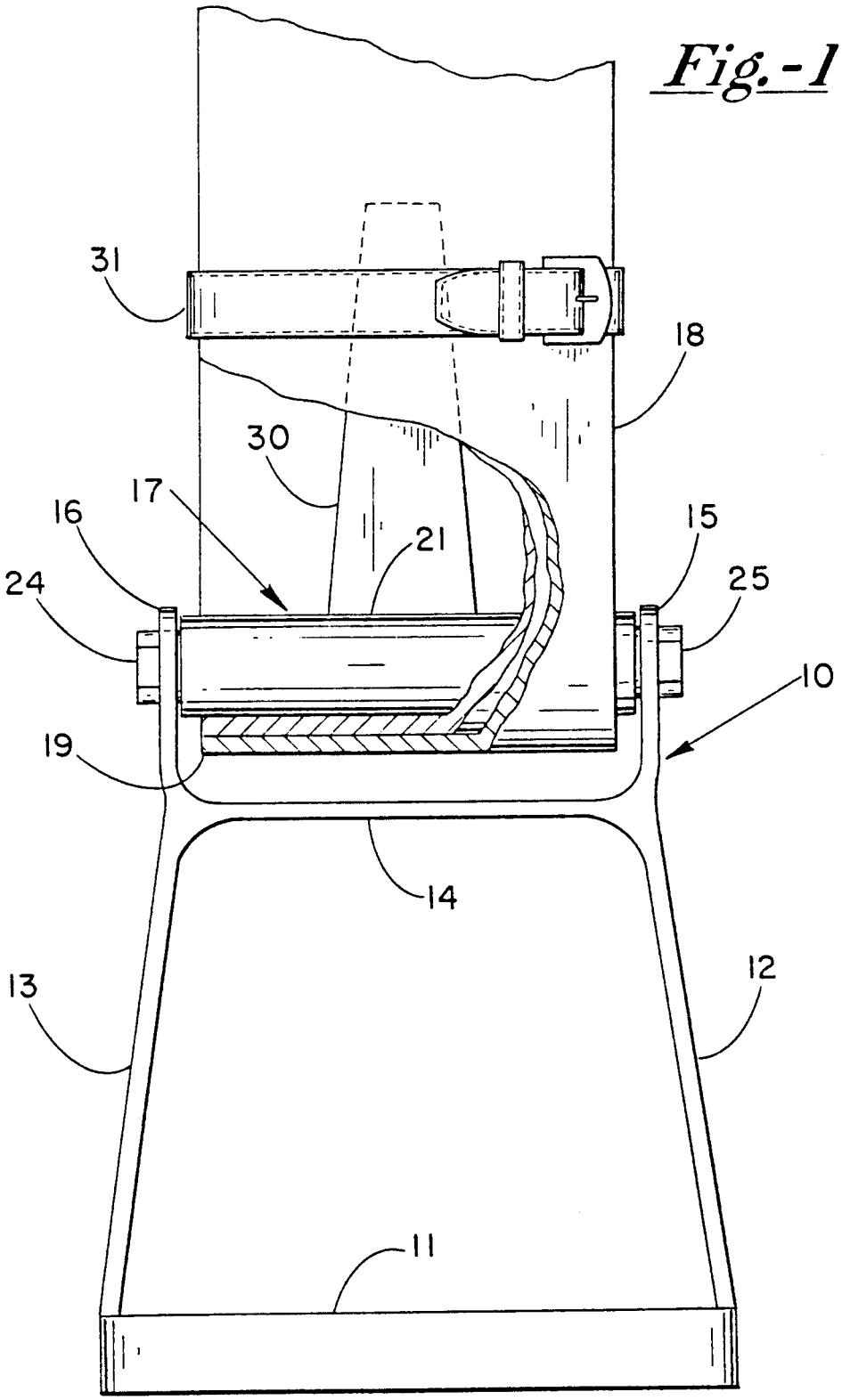
FIG. 1 is a partial breakaway illustration of a preferred embodiment of the invention mounted to hold the stirrup attached to the stirrup strap.

The stirrup, which is generally designated by reference numeral 10, which is used to illustrate the construction and function of the instant invention is generally referred to as an English style. It has a footrest 11 at the bottom, side members 12 and 13 which are somewhat angled inward and extend upward and which are closed together by a crossmember 14. Extending upward as virtually a further extension of side members 12 and 13 are ears or flanges 15 and 16 which are spaced apart and parallel to one another. A cylindrical stirrup bolt assembly, generally designated by reference numeral 17, extends across the open end of stirrup 10 between the ears or flanges 15 and 16 for attaching or coupling the stirrup to a stirrup strap 18. Conventionally, stirrup strap 18 extends downward along the side of the horse from a saddle fender, not shown, and is folded back on itself to have two sides or runs and a closed loop generally designated by reference numeral 19. Stirrup bolt assembly 17 rests on the closed loop 19 of stirrup strap 18 and stirrup 10 hangs down from the bolt assembly and strap. Also, conventionally, stirrup strap 18 has a buckle, not shown, so that the runs or sides of stirrup strap 18 can be lengthened or shortened to raise and lower the stirrup to accommodate riders of different heights.

Stirrup bolt assembly 17 has a cylindrical hollow outer housing 21 containing a pair of cylindrical piston or plunger members 22 and 23 which are coaxial with one another and with respect to housing 21. Piston members 22 and 23 are movable both axially and rotatably within the hollow chamber of housing 21. Extending outward axially from one end of each of the piston members 22 and 23 are pins or rods 24 and 25, respectively. Pins 24 and 25 are keyed or shaped to engage corresponding keyed or shaped openings or apertures 26 in the ears or flanges 15 and 16 of stirrup 10. One manner of doing this, as illustrated in the drawings, is to make the openings 26 and the pins 24 and 25 hexagonal. In this fashion, then, any swinging of stirrup 10 about the axis of stirrup bolt assembly 17 will cause pistons 22 and 23 to correspondingly rotate within the confines of housing 21.

At their inner ends pistons 22 and 23 have a centered relatively deep recess 28 with each end of a helically wound spring 29 resting in recesses 28 with the spring at least partially compressed thereby urging pistons 22 and 23 axially outward so that there is a substantial gap 27 between the inner ends of pistons 22 and 23. Extending upward from housing 21 is an arm 30 which is fixedly attached to housing 21 in some convenient fashion. Arm 30 extends upward between the runs of strap 18 to keep housing 21 from rotating. A cross-strap 31 may be provided which can be tightened to securely hold arm 30 in place between the runs of saddle strap 18.

On the outer surface of piston members 22 and 23 are curved grooves or slots 32 and 33 which are preferably shaped in the form of the start of a helix. Extending radially inward from housing 21 are teeth or fingers 34 and 35 which are respectively engaged in slots or grooves 32 and 33. Rotation of rods or pins 24 and 25 causes pistons 22 and 23 to rotate about their longitudinal axes and teeth or fingers 34 and 35 respectively engaged in grooves 32 and 33 force pistons 22 and 23 to move axially inward within housing 2 in opposition to further compress spring 29. While not shown in the drawings, grooves or slots similar to 32 and 33 will normally be provided on each side of the pistons 22 and 23 so that the same action will take place whether pins 24 and 25 are rotated clockwise or counterclockwise. As pistons 22 and 23 are drawn inward, pins 24 and 25 start to withdraw from the corresponding openings 26 in the stirrup with which they are engaged and when pistons 22 and 23 are drawn far enough inward, pins 24 and 25 will disengage from openings 26 and stirrup 10 will fall away. The curved slots or grooves 32 and 33 can be designed as desired to control the point at which the stirrup will fall free in the manner described. Also, the cross-strap, not shown, which holds arm 30 in place can be loosened somewhat so that there is some added tolerance as to the angle when the stirrup will be released.

Figure 2:
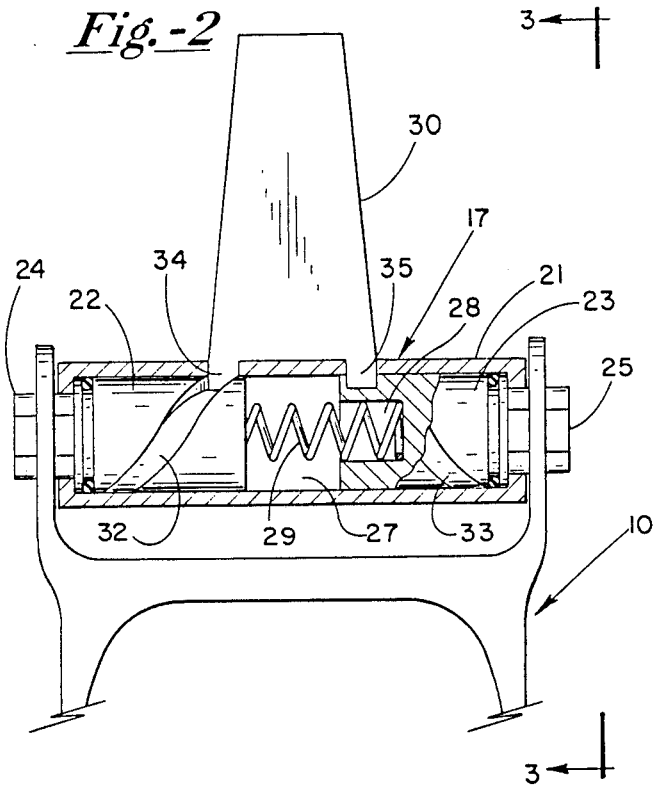
FIG. 2 is a sectioned view of a preferred embodiment of the invention as it appears when holding the stirrup attached.
Figure 3:
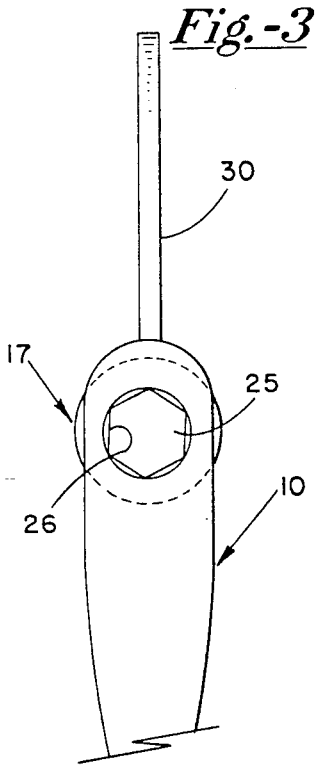
FIG. 3 is an end view as seen along viewing lines 3—3 of FIG. 2.
Figure 4:
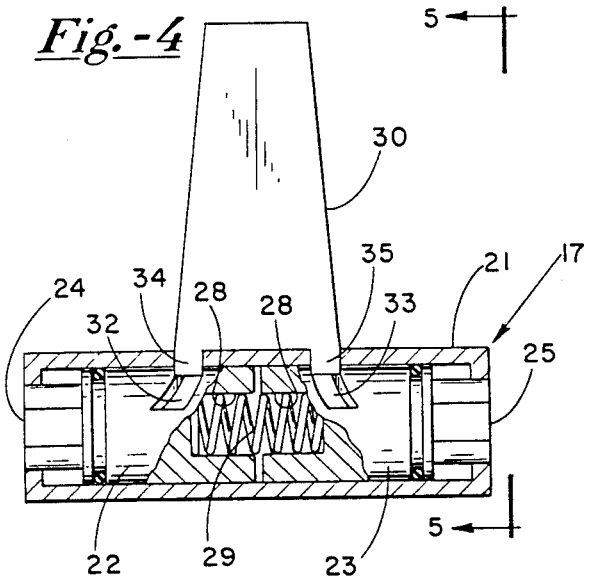
FIG. 4 is a section view similar to FIG. 2 illustration the preferred embodiment of the invention as it appears when the stirrup is released.
Figure 5:
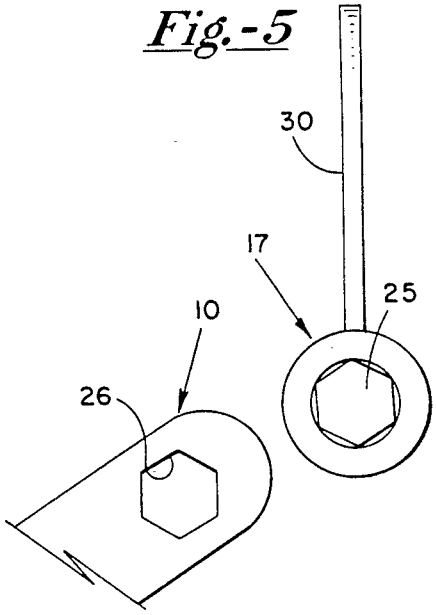
FIG. 5 is an end view as seen along viewing lines 5—5 of FIG. 4.

Referring to FIGS. 1, 2 and 3, with no rider mounted the saddle fender, not shown, the stirrup strap 18 with arm 30 sandwiched therebetween, bolt assembly 17 and stirrup 10 are generally in a common vertical plane along the side of the horse. The force of spring 29 keeps the keyed rods or pins 24 and 25 engaged in the keyed openings or recesses 26 in the stirrup. With a rider mounted, the same relative arrangement is maintained even though stirrup 10 might swing a few degrees forward or backward when the rider mounts or dismounts or while riding. When stirrup 10 swings in an arc about the axis of stirrup bolt assembly 17 pistons 22 and 23 are rotated by virtue of the keyed openings 26 being in engagement with rods 24 and 25 so that pistons 22 and 23 are drawn inward. When the rider has his or her foot in the stirrup and causes the stirrup to swing in an arc that exceeds a preset angle then, as illustrated in FIG. 4, piston members 22 and 23 are drawn far enough inward in gap 27 in housing 21 so that rods or pins 24 and 25 become disengaged from openings 26 and the stirrup 10 falls free. In actual use, when the rider is mounted and seated in the saddle with the feet resting on the stirrup footrest 11, normally the feet are turned to face in the same direction as the horse thereby turning stirrup 10 so that it is in a generally vertical plane which is about ninety degrees to the unmounted condition. This twists stirrup strap 18 with respect to the saddle fender but the lower part of strap 18, the bottom closed loop 19 of the stirrup strap and bolt assembly 17 turn with the stirrup so that the relative angular locations are the same as described hereinabove. If the rider should get a foot entangled or caught in the stirrup after falling off the horse or while mounting or dismounting and the horse should start running, the stirrup will swing in an arc about the axis of the stirrup bolt assembly 17 as described hereinabove to disengage the stirrup from the bolt assembly.

A feature of this device is that it is quite easy to set or reset in place. One merely has to push rods or pins 24 and 25 inward, then bring the stirrup opening 26 into line and then release the pin or rod so that it engages the stirrup opening.

I claim:

1. An automatic safety release attachment for a stirrup having a bottom foot-supporting member, side members attached at one end to the ends of the foot-supporting member and extending upward therefrom generally parallel to one another with an open space between the side members at their upper ends, said stirrup used in combination with a horse saddle fender and a stirrup strap extending downward from said fender with said stirrup strap folded back on itself forming a loop at its lower end, said stirrup extending downward from the stirrup strap, said quick release safety attachment comprising:

a recess in each of the stirrup side members near their upper ends;

cylindrical piston means in the loop at the lower end of the stirrup strap extending axially across the space between the stirrup side members;

spring means for urging the ends of said piston means into engagement with the recesses for holding the stirrup coupled to the stirrup strap; and means for applying a force on said piston means opposite the force of said spring means as the stirrup swings in an arc of a predetermined angle for disengaging the ends of said piston means from said recesses to uncouple the stirrup from the stirrup strap.

2. The safety release attachment as described in claim 1 wherein said means for applying a force on said piston means to disengage said piston means from said recesses, comprises:

a cylindrical housing resting in the stirrup strap loop, said piston means rotatably and axially slidable within said housing;

a lever arm attached to said housing, said lever arm extending radially from said housing and retained substantially vertically by said saddle strap;

groove means on the exterior of said piston means; and finger means extending radially inward on said housing engaged in said groove means, said finger means acting in said groove means to apply a force on said piston means against the force of said spring means to move said piston means axially inward in said housing to move the ends of said piston means out of said recesses as said stirrup swings in an arc.

3. The safety release stirrup attachment as described in claim 1 further including a hollow cylindrical housing resting lengthwise in the stirrup strap loop;

said piston means comprising a pair of cylindrical piston members resting coaxially end to end in said housing, said piston members being rotatable and axially movable within said housing;

a spring in compression in said housing between the adjacent ends of said piston members urging said piston members axially outward so that their outer ends are engaged in the recesses in the stirrup side members;

the outer ends of said piston members and said recesses being keyed so that as the stirrup swings about the stirrup strap loop said piston members rotate about their axes;

a curved groove on the exterior of each of said piston members;

a lever arm extending upward from said housing between the two sides of the stirrup strap;

finger means attached to said housing, said finger means extending radially inward to engage the curved grooves;

said grooves being patterned and said finger means acting in said grooves to pull said piston members axially inward in said housing against the force of said spring to disengage the ends of the piston members from said recesses when the stirrup has swung in an arc of a predetermined angle.

* * * * *